United States Patent [19]

Horton

[11] Patent Number: 5,010,674

[45] Date of Patent: Apr. 30, 1991

[54] SPRING ACTUATED SAFETY CARTRIDGE

[76] Inventor: Don Horton, 5902 Kirkwood Pl. N., Seattle, Wash. 98103

[21] Appl. No.: 401,098

[22] Filed: Aug. 31, 1989

[51] Int. Cl.[5] ..... F41A 17/00

[52] U.S. Cl. ..... 42/70.11

[58] Field of Search ..... 42/70.11

[56] References Cited

U.S. PATENT DOCUMENTS

| | | | |
|---|---|---|---|
| 3,638 | 9/1869 | Powers | 449/46 |
| 37,946 | 3/1863 | Bonano | 89/1.1 |
| 2,530,560 | 7/1947 | Young | 42/70.11 |
| 2,836,918 | 8/1955 | Pula et al. | 42/70.11 |
| 2,943,411 | 7/1960 | Salva | 42/66 |
| 3,027,674 | 4/1962 | Mahan | 42/66 |
| 3,147,708 | 9/1964 | Ferguson | 102/442 |
| 3,208,176 | 9/1965 | Giles | 42/66 |
| 3,360,880 | 1/1968 | Finnegan | 42/66 |
| 3,708,901 | 1/1973 | Wolter | 42/70.11 |
| 4,398,366 | 8/1983 | Wernicke | 42/70.11 |
| 4,569,144 | 2/1986 | Thurber | 42/70.11 |
| 4,681,038 | 7/1987 | Washburn | 102/464 |

*Primary Examiner*—Harold J. Tudor

[57] ABSTRACT

It is a spring operated device which can be placed in a gun like a cartridge. It does not fire a bullet like a conventional cartridge. When the gun is fired a spring will release and render the gun inoperable. In one embodiment, the device can be reset by pushing a rod down the barrel of the gun and compressing the spring.

3 Claims, 2 Drawing Sheets

SPRING ACTUATED SAFETY CARTRIDGE

BACKGROUND OF THE INVENTION

This invention is related to another invention titled Safety Cartridge, Ser. No. 07/150,240, filed Jan. 29, 1988.

This invention is of a spring device which can be inserted into a gun like a bullet and, when actuated by a firing pin, is released and disables the gun.

It is an object of this invention to provide a device which, when a gun is fired by accident, or by a person not familiar with the gun, disables the gun.

SUMMARY OF THE INVENTION

The present invention consists of a coiled ribbon of spring steel mounted on a bullet rim. The bullet rim contains a plunger that can be pushed by the firing pin and in turn can push a second pin that releases the spring. When the spring is released, it expands and lengthens as it unwinds.

DESCRIPTION OF THE PREFERRED EMBODIMENT

Figure 1:
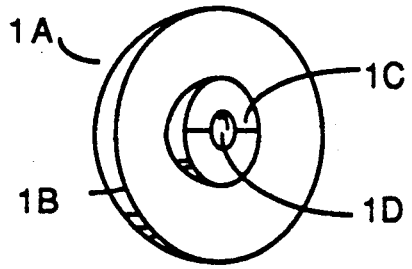
FIG. 1 illustrates the rim and base.

FIG. 1 illustrates a single part 1 which has a rim 1A and a pedestal 1B rising up from the rim. The pedestal has a diameter smaller than the rim. A slot 1C is cut through the center of the pedestal and a hole 1D goes through the center of the rim and pedestal.

Figure 2:
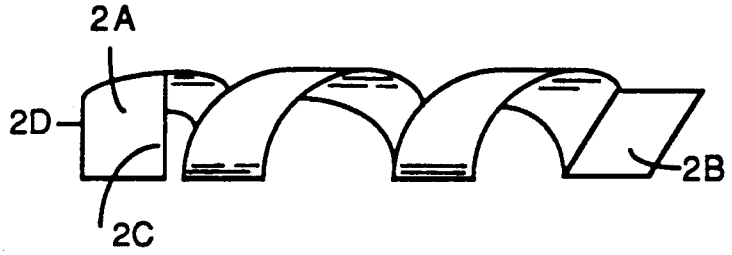
FIG. 2 illustrates the spring.

FIG. 2 illustrates a spring 2 made from a ribbon of coiled flat spring steel. The base of the spring 2A is flat and one edge is set into the bottom of the slot 1C in the pedestal. (The edge of the spring in the bottom of the slot is the trailing edge 2D. The edge opposite from this edge is the leading edge 2C.) The spring is bent around the pedestal, beginning where the spring extends from the slot, into a spiral. In the compressed state, the spiral has a diameter of a cartridge wall. Where the spring is adjacent to the pedestal it fits snugly against the pedestal to help hold the rim-pedestal in place and may have a somewhat smaller diameter than a cartridge wall. At the opposite end of the spiral from the rim-pedestal is the front 2B, where the spring is bent again and goes through a deep slot 4B in the retaining pin 4.

Figure 3:
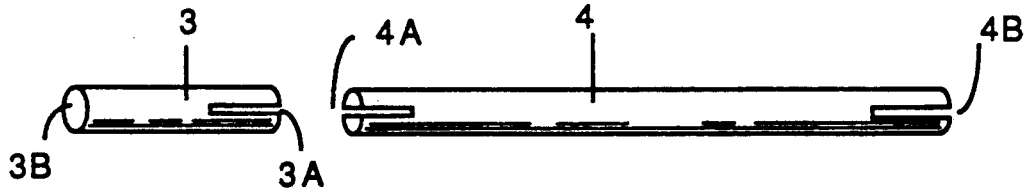
FIG. 3 illustrates the plunger and spring retaining pin.
Figure 4:
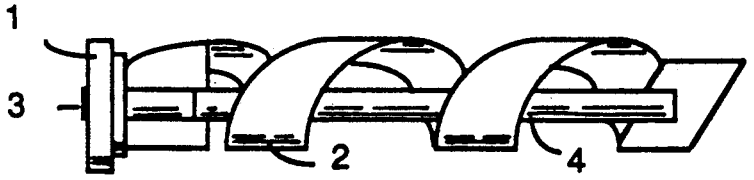
FIG. 4 illustrates the device assembled.

FIG. 3 illustrates a plunger 3 and a retaining pin 4. The plunger is set in the hole 1D (through the center of the rim-pedestal). The plunger has a slot 3A cut in the front end so it can fit astride the spring. The spring, in the slot 1C in the pedestal 1B, crosses the plunger hole. When the plunger is in its normal position it does not quite extend to the leading edge 2C of the spring. When the plunger is hit by the firing pin and pushed forward it goes to, or slightly beyond, the leading edge 2C of the spring.

The retaining pin 4 has a slot at each end. The front end of the spring 2B is firmly mounted into deep slot 4B at the front end of the retaining pin. The retaining pin extends through the center of the coiled spring to the leading spring edge 2C at the base of the spring. When the spring is tightened, by rotating the front of the spring, the shallow slot 4A at the base of the retaining pin is a aligned with the leading edge of the spring 2C above the hole in the pedestal. The retaining pin shallow slot 4A goes over the leading edge and the end of the retaining pin 4A is adjacent to the front end of the plunger.

When the plunger base 3B is hit by the firing pin of the gun the plunger pushes the retaining pin off of the spring. The spring can then uncoil.

Before the retaining pin hit, the coiled length of the cartridge is equal to, or only slightly less than, the length of a revolver cylinder. After the retaining pin is hit, releasing the spring, the coil lengthens. When the coil lengthens, it will extend into the barrel and prevent the revolver cylinder from rotating, thus disabling the gun.

A gun that is not a revolver would also be disabled because the spring will be stuck in the chamber.

Any attempt to extract the cartridge by using the extractor or ejector of a gun will result in the removal of the rim-pedestal from the spring. The spring would remain in the gun.

A second embodiment has additional means for resetting the cartridge after it has expanded in the gun, allowing simple extraction.

Figure 5:
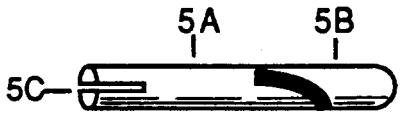
FIG. 5 illustrates a spring retaining pin reset guide sleeve.
Figure 6:
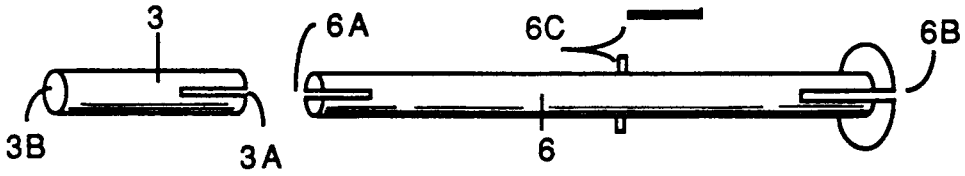
FIG. 6 illustrates a resettable spring retaining pin.
Figure 7:
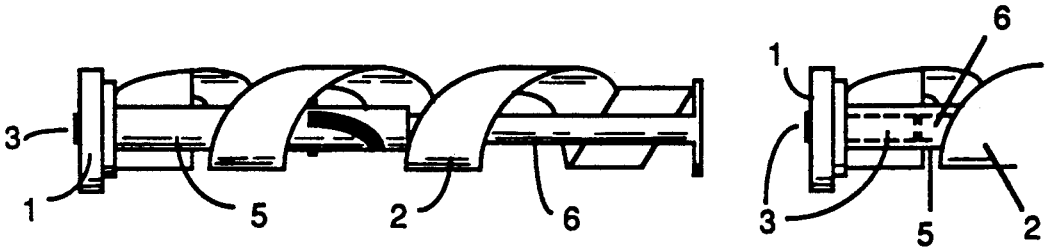
FIG. 7 illustrates the resettable device assembled.

Referring to FIG. 5, a hollow sleeve 5A is mounted securely on the rim-pedestal. The sleeve has mounting slot 5C that allow it to fit over the spring. The sleeve has guide slot 5B which form a sprial until near the end adjacent to the base, where the slots are straight in order to guide the pin straight onto the spring. The sleeve encloses the plunger and the bottom portion of the retaining pin. The plunger can slide freely within the sleeve. The retaining pin 6 has pin 6C (see FIG. 6) which slides in the guide slots. The retaining pin can move in the sleeve but its rotation is controlled as it moves in the sleeve by pin 6C riding in the slots. The retaining pin also has a head 6B just above the spring.

The device can be reset by pushing downward on the retaining pin head 6B with a dowel or other tool. As the retaining pin is pushed downward pin 6C in the guide slots 5B force the retaining pin to rotate and then guide the shallow slot straight onto the leading edge of the base of the spring. (The spring is forced to coil as the retaining pin rotates because the front of the spring is in the retaining pin deep slot.)

While the above descriptions contain many specificities these should not be construed as limitations on the scope of the invention but rather as exemplifications of the preferred embodiments.

For example, a device with a circular concave disc could be mounted in a flexible casing. The disc would have a rod that extends from the center of the disc out a hole in the back of the casing so that the rod would be hit by the firing pin. A strike from the firing pin would cause the rod to push on the center of the concave disc to "turn the disc inside out."Blocking means could prevent the disc from going too far "inside out", so the outside radius of the disc would be held in an expanded state. Lever arms could, also be used instead of a disc.

Another approach would be to use latching mechanisms to keep the spring compressed A device struck by the firing pin could release the latches and allow the spring to expand.

What is claimed:

1. A cartridge, to be inserted into a gun having a chamber and a firing pin, comprising:

(a) a spring of a diameter that fits into the chamber of the gun when compressed but would expand into tight engagement if unwound;

(b) means to hold the spring in a compressed state; and (c) means for the firing pin to release the means holding the spring in a compressed state.

2. A cartridge, to be inserted into a gun having a chamber and a firing pin, comprising:

(a) a rim;

(b) a spring mounted on the rim;

(c) means to hold the spring in a compressed state;

(d) means for the firing pin to release the spring from the means holding the spring in a compressed state; said spring having a diameter that fits into the chamber of the gun when compressed but would expand into tight engagement if unwound; and (e) means to release the spring from the rim if the rim is extracted when the spring is in an expanded state.

3. A cartridge having a cirular base with a center to be inserted into a gun having a chamber and a firing pin, comprising:

(a) a rim plate having;

(1) a hole in the center;

(2) means to mount a spring;

(3) means to support a slidable plunger;

(b) a coil spring having a base mounted to the rim and a front end;

(c) a pin having;

(1) means at the front end to mount to the spring;

(2) means at base to slidingly mount the spring;

(d) a plunger mechanism having;

(1) means to be moved by the firing pin of a gun;

(2) means to slide across the spring and push the pin when hit by the firing pin.

* * * * *